United States Patent [19]

Schantz

[11] 4,359,702

[45] Nov. 16, 1982

[54] RELAY FOR MICROWAVE OVEN

[76] Inventor: Spencer C. Schantz, 5880 Anchorage Rd., Oconomowoc, Wis. 53066

[21] Appl. No.: 171,773

[22] Filed: Jul. 24, 1980

[51] Int. Cl.[3] ..... H01H 50/02; H01H 50/24; H01H 50/34

[52] U.S. Cl. ..... 335/2; 335/128; 335/133; 335/196; 340/392; 340/400; 340/403; 361/104

[58] Field of Search ..... 335/128, 219, 133, 135, 335/196, 2; 340/392, 400, 403; 361/104

[56] References Cited

U.S. PATENT DOCUMENTS 3,298,020 1/1967 Malin ..... 340/392

*Primary Examiner*—G. Z. Rubinson
*Assistant Examiner*—S. D. Schreyer
*Attorney, Agent, or Firm*—Henry C. Fuller

[57] ABSTRACT

Disclosed herein is a combination relay, suppression resistor and end of cycle bell in a compact unitary assembly intended for use in a microwave oven. The size of the relay is reduced by employing a bifurcated contact strip which has legs surrounding the relay coil pole piece and a contact actuator which is U-shaped to move within a plane which intersects the coil and bobbin. A plastic housing encloses these components and provides a support for the bell. The surge suppression resistor can be a few turns of magnet wire wrapped around the protective covering on the relay coil core.

14 Claims, 7 Drawing Figures

100
102
122
52
69
108
90
66
60
96
26
16
20
98
76
14
10

102
122
104
53
58
52
69
66
20
60
90
18
84
64
100
16
50
32
76
44
96
30
98
28
24
10
14
82
47

RELAY FOR MICROWAVE OVEN

BACKGROUND OF THE INVENTION

The invention relates to a combination relay, surge suppression resistor and end of cycle bell which are assembled in an integral compact unit to replace a separate bell, relay and surge resistor employed in the prior art microwave oven circuit. As in the prior art, with the instant invention a surge suppression resistor is employed to minimize flickering of lights in the home when the microwave oven is turned on. When the push to start switch on the microwave oven is actuated to initiate the timed cooking cycle, current flows to the primary of the transformer through a surge suppression resistor. After several milliseconds, the relay coil causes closing of the contacts of the relay to shunt out the surge resistor. In the prior art, the relay armature was provided with a striker which hit a separately mounted bell when the timer de-energized the circuit and relay at the end of the selected cycle. Because of space limitations in a microwave oven, it is desirable to reduce the size as much as possible of these components. The present invention combines the resistor, bell and relay in one unit and provides a compact relay construction.

SUMMARY OF THE INVENTION

The invention provides a combination relay, end of cycle bell and surge suppression resistor for a microwave oven arranged in a compact, unitary assembly and in which the bell is supported on the bridge of a plastic housing, with the relay armature positioned above the top wall of the plastic housing and having a springy bell striker extending beneath the bridge and alongside the forward wall of the plastic housing. A compact relay structure is provided which includes a contact leaf with the desirable long spring length but with a short projection distance past the core. This is accomplished by use of a contact leaf with a bifurcated leg structure in which the legs surround the bobbin sleeve and the relay core and terminate in a cross member which makes an electrical connection to a terminal. The cross member and terminal are riveted to a terminal block.

The contact actuator also is shaped and positioned to reduce the overall size of the relay. The contact actuator has a U-shaped frame portion with the bobbin and coil projecting into the gap between the legs. The contact actuator is guided at its top for vertical movement in a plane which intersects the coil and bobbin. The surge suppression resistor, in one embodiment, comprises a few turns of magnet wire wrapped on the outer surfeace of the relay coil and, in another embodiment, a thermistor mounted within the plastic housing.

Further objects, advantages and features of the invention will become apparent from the disclosure.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
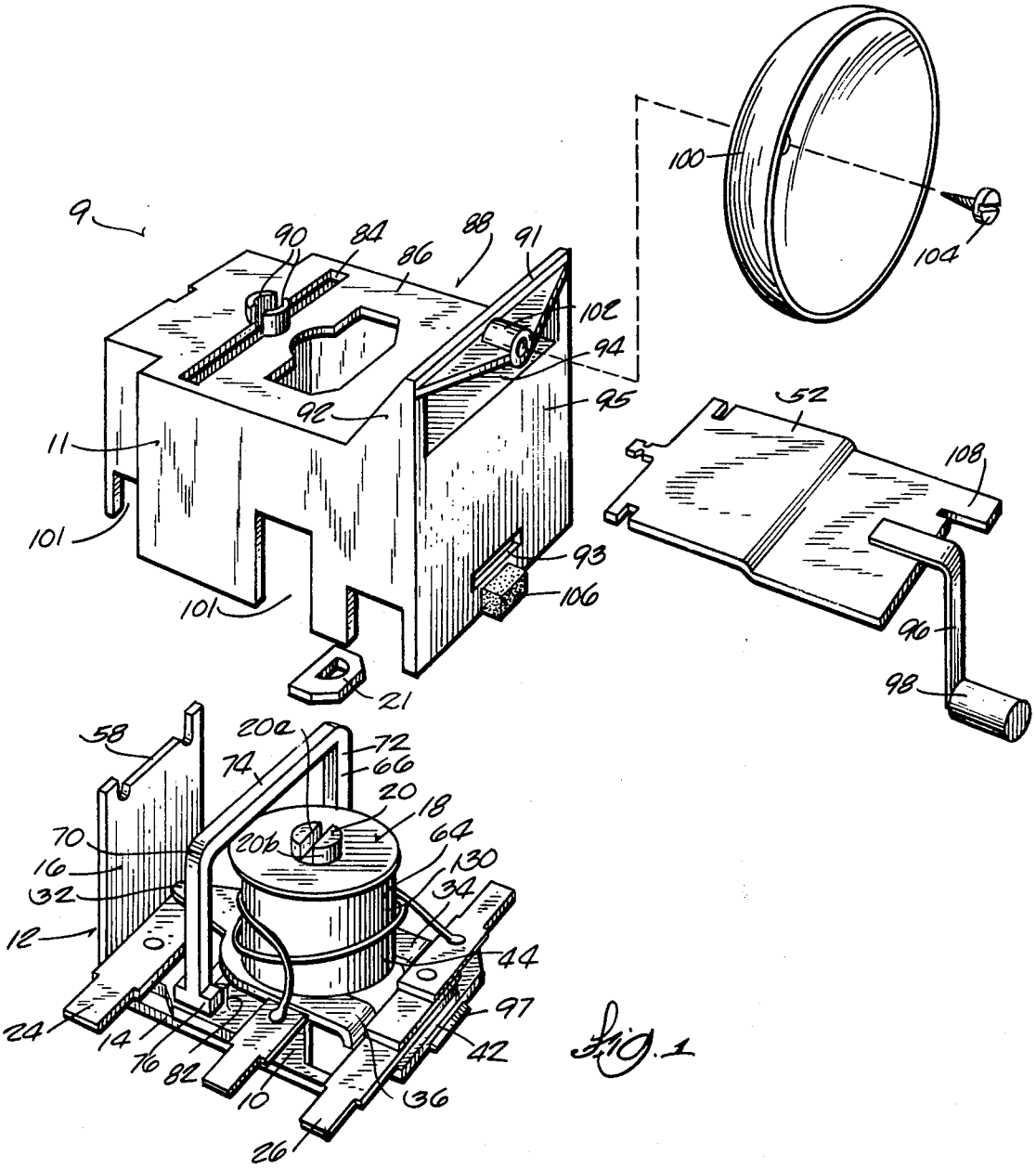
FIG. 1 is an exploded perspective view of the combination relay-bell in accordance with the invention.
Figure 2:
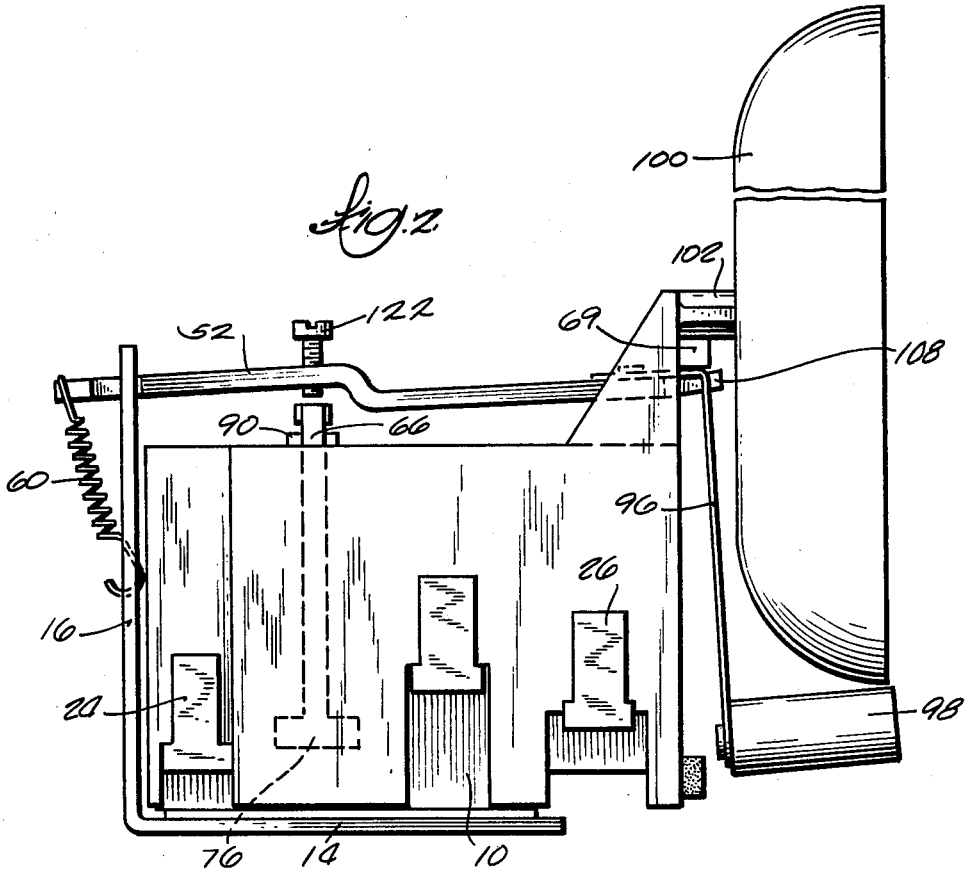
FIG. 2 is an enlarged side elevational view of the apparatus shown in FIG. 1.

In the drawings, FIG. 1 discloses the relay combination 9 of the invention which includes an insulative base or terminal block 10 to which all of the components are connected directly or indirectly. A plastic housing 11 encloses most of the components supported on the terminal block 10. The relay includes an L-shaped magnetic frame 12 with a bottom leg 14 and an upstanding leg 16 (FIGS. 1, 2). The frame 12 and a plastic coil bobbin 18 are secured to the terminal block 10 by the magnetic pole piece or core 20 which extends through the bobbin 18. The pole piece has protrusions at one end to hold the bobbin to the frame 12.

Figure 3:
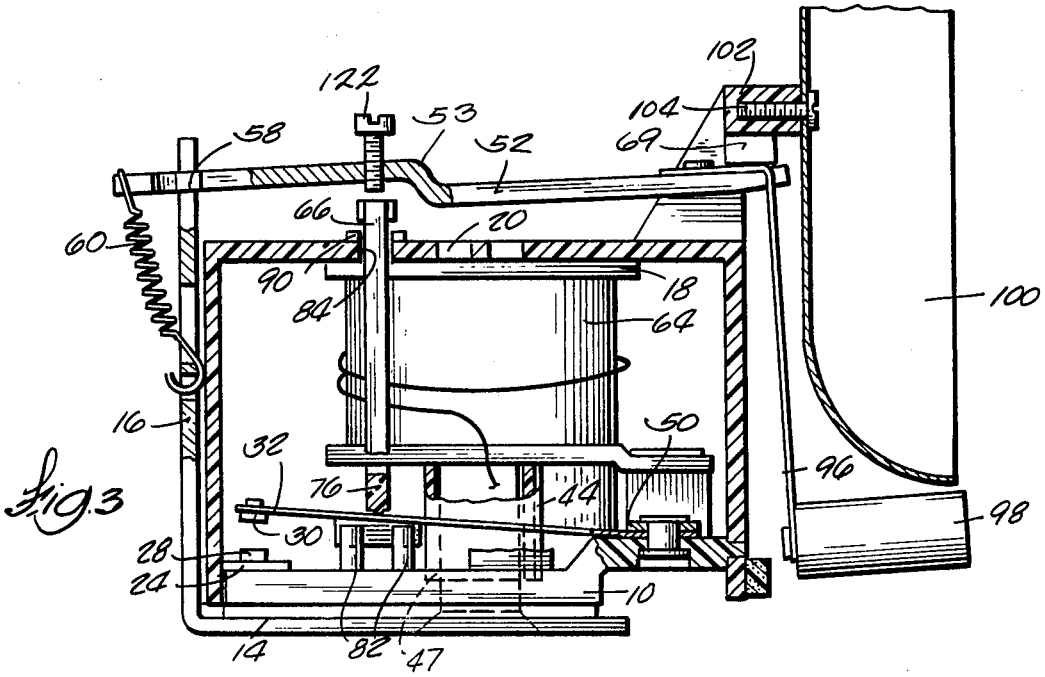
FIG. 3 is a view similar to FIG. 2 in fragmentary section.
Figure 4:
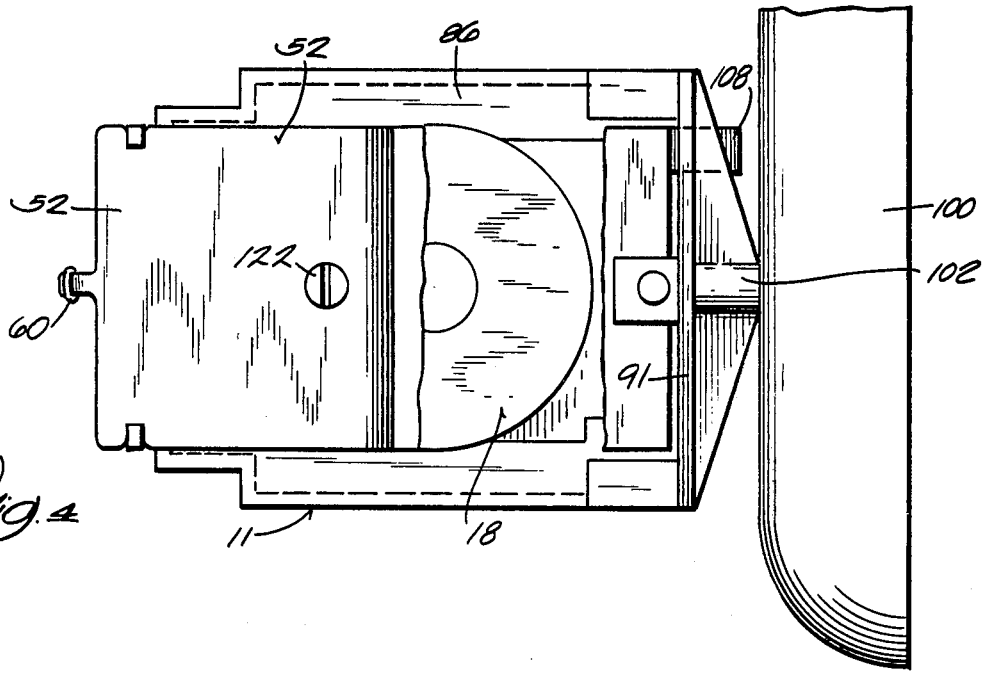
FIG. 4 is a top view partially broken away of the apparatus shown in FIG. 3.
Figure 5:
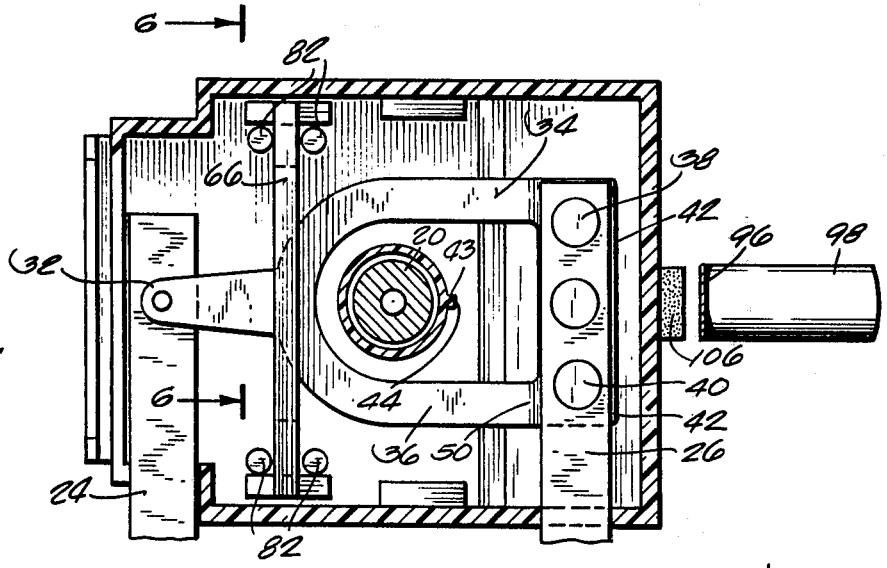
FIG. 5 is a plan view with parts broken away.
Figure 6:
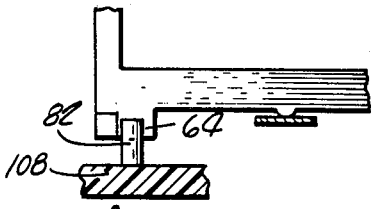
FIG. 6 is a view taken along line 6—6 of FIG. 5 showing the contact actuator and guide.

A terminal strip 24 is connected to the terminal block 10 and is provided with a contact 28 (FIG. 3) positioned to engage a contact 30 on a contact strip 32. A terminal strip 26 is similarly connected to the terminal block 10. To provide maximum spring length for reliability and yet compactness of the solenoid, the copper contact strip 32 is bifurcated (FIG. 5) and, in this regard, has legs 34 and 36 which form a U-shape and are anchored to the terminal 26 by rivets 38 and 40. An integral cross leg 42 connects the legs 34 and 36 and is anchored to the terminal strip 26 and is in electrical connection with the terminal strip 26. The legs 34 and 36 surround extension 44 of the plastic bobbin 18, as illustrated in FIG. 5. The extension 44 surrounds the core and isolates the core from the surrounding contact strip. The extension interfits and is keyed by a key 43 in a recess 47 in the terminal block 10. The terminal strip arrangement surrounding the core shortens the overall construction as compared with U.S. Pat. No. 3,848,205 in which the contacts are spaced a substantial distance from the core 20. There is a slight bend at 50 (FIG. 3) to cause the contacts to be normally open.

The armature 52 (FIGS. 1 and 2) has a stepped construction which facilitates compactness. The step is located adjacent the core 20 and provides a larger air path adjacent to non-shaded pole 20*a* (FIG. 1) than if a flat armature is used. The increased air path minimizes undesirable transverse flux leakage since there is an intentioned air gap over non-shaded pole 20*a*. The armature is hingedly supported in the notch 58 in the magnetic frame portion 16 and a spring 60 urges the armature upwardly against a stop 69 (FIG. 3) on the plastic housing 11, as subsequently described.

The contact strip 32 is depressed by a contact actuator 66 (FIG. 1) when the coil 64 on the bobbin is energized. The contact actuator 66 is generally rectangular in shape or loop shape with a yoke portion having legs 70 and 72 connected by an upper cross portion 74 and a lower cross portion 76. The cross portion 76 is immediately above the contact strip 32 which supports the actuator. The cross portion 74 is engaged by the armature 52 by means in the form of a screw 122 when the coil is energized to depress the actuator and hence the contact strip and complete the electrical connection. The contact actuator 66 is guided for vertical movement by pairs of spaced upstanding pegs 82 on the terminal block 10. The top of the switch actuator 66 extends through a slot 84 in the top wall 86 of the plastic housing 88. Upstanding tabs 90 on opposite sides of the slot 84 guide the upper end of the actuator 66. The pegs 82, slot 84 and tabs 90 are arranged to guide movement of the switch actuator in a plane which intersects the coil bobbin. This construction reduces the longitudinal extent of the relay.

The plastic housing 11 has slots 93 at the opposed end walls 95 (FIG. 1) which interfit with tabs 97 on the terminal block. Downwardly open slots 101 enable the housing 11 to fit over the laterally extending terminal strips, and the plastic housing 11 includes a bridge 91 supported by upstanding wings 92 which provide a slot 94.

The armature 52 has a springy arm 96 secured thereto with a striker 98 positioned to hit the bell 100 which is supported by a threaded boss 102 and a screw 104 on the bridge 91. A foam block or magnet 106 acts as a damper to limit striker vibration. The striker, of course, hits the bell when the armature is released as the relay is de-energized when the timer deactivates the circuit, as hereinafter described. To properly position the striker 98 so that the bell has the appropriate and characteristic ring, the armature 52 must stop its travel or movement prior to the striker 98 hitting the bell. Over travel caused by the flexing of the material then causes the member 98 to hit the bell. To regulate the stop position of the armature and the striker, a bendable tab 108 on the armature is positioned to coact with a depending stop 69 on the bridge 91. The use of a magnet 106 causes a slight retention of the arm 96 to cause a reverse flex of the arm which causes an increase in velocity of the striker 98, which hence delivers more kinetic energy to the bell 100 for a louder ring.

Figure 7:
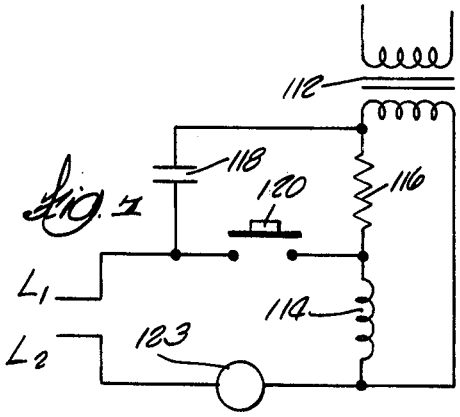
FIG. 7 is a schematic circuit diagram showing the circuit in which the relay-bell combination is employed.

The relay is employed in a circuit (FIG. 7) which includes a transformer 112, the relay coil 114, a resistor 116, relay contacts 118, a push button switch 120 and a timer 123. In operation, when the switch 120 is actuated and the timer 122 has been preset for the selected cycle, an initial current surge will go through the primary of the transformer 112, surge suppression resistor 116 and through the switch 120. In a matter of milliseconds, the contacts 118 in the relay close and shunt the suppression resistor 116. In the interest of compactness and cost, the resistor can be in the form of a winding of fine wire, such as magnet wire, 130 wrapped around and supported on the form provided by the coil which harmlessly fuses in overload. The coil provides a form for the resistor 130 and also a heat sink. The size of the magnet wire 130 is selected to afford self fusing with a modest current to provide a fail safe system. Alternatively, a thermistor can be employed.

When the timer opens the circuit, the relay coil 114 is de-energized, releasing the armature. The armature should stop in the FIG. 3 position so that over travel only will cause the striker 98 to hit the bell 100.

I claim:

1. In an electromagnetic device having a ferromagnetic frame, a core mounted on the frame, a coil of wire wound on a bobbin which is around said core and having a ferromagnetic armature pivoted to said frame adjacent to said core for movement toward and away from the end of said core, the improvement comprising a contact strip having a bifurcated portion surrounding the core of said bobbin, with the bifurcated portion anchored to a terminal strip on one side of said coil and a contact structure at the other end of the contact strip to maximize the length of the contact strip and reduce the overall length of said device.

2. The improvement of claim 1 including a loop shaped switch actuator and means for supporting said switch actuator so that said coil extends within said loop and wherein the plane of movement of said switch actuator intersects said coil to minimize the size of the electromagnetic device.

3. The improvement of claim 1 wherein said device is in a circuit having a suppression resistor and said resistor comprises turns of fusible wire wrapped around the coil.

4. The improvement of claim 1 wherein said bobbin has an insulative extension which surrounds said core and isolates the core from the surrounding contact strip, a terminal block supported on said frame, and a recess in said block to receive said extension and lengthen the isolation of the core.

5. The improvement of claim 1 including a housing and a switch actuator in the form of a loop shaped yoke which receives a portion of the coil within the plane of the loop and guide means on the terminal block for supporting and guiding vertical movement of the switch actuator in response to engagement by said armature and spring pressure of said contact strip.

6. The improvement of claim 1 wherein said core has a non-shaded pole and wherein said armature has a stepped construction to provide a larger air path adjacent the non-shaded pole.

7. The improvement of claim 1 including a housing and wherein said housing includes a top wall and a bridge portion spaced from said top wall, a bell and screw means connecting said bell to said bridge portion to support said bell on said housing and said armature having an arm with a flexible bell striker connected to said armature and extending beneath said bridge portion including a bendable finger on said armature and a stop on said bridge for adjusting the position of said striker, said finger being adjustable to stop travel of the striker prior to contact of the striker with the bell to enable overtravel of the striker to cause contact with the bell.

8. The improvement of claim 7 including a magnetic damper for said striker positioned on said housing to engage one of said striker and said arm to restrain initial movement to cause an increase in velocity of the striker as the striker hits said bell.

9. In an electromagnetic device having a ferromagnetic frame, a pole piece, a bobbin mounted on the frame and around said pole piece, a coil of wire wound on the bobbin and having a ferromagnetic armature pivoted to said frame adjacent to said bobbin for movement toward and away from the end of said pole piece, including a housing and a switch actuator in the form of a loop shaped yoke which receives a portion of the coil, guide means on a terminal block for supporting and guiding vertical movement of the switch actuator in a plane through the coil in response to engagement by said armature and spring pressure of said contact strip.

10. The improvement of claim 9 wherein said housing has a top wall and includes a bridge portion spaced from said top wall, a bell and screw means connecting said bell to said bridge portion to support said bell on said housing and said armature having a striker connected to said armature and extending beneath said bridge portion.

11. The improvement of claim 9 wherein said guide means for said switch actuator includes a slot in said housing, a guiding wall structure associated with said slot, and upstanding pegs on said terminal block.

12. In an electromagnetic device having a ferromagnetic frame, a core mounted on the frame, a coil of wire wound on the core and having a ferromagnetic armature pivoted to said frame adjacent to said core for movement toward and away from the end of said core, a housing for said device, said housing including a top wall, a housing bridge portion spaced from said top wall to define a slot, and connecting means connecting a bell to said bridge portion above said slot to support said bell in cantilevered relationship on one side of said housing and said armature having a striker connected to said armature to pivot with said armature and said armature extending beneath said bridge portion and through said slot for movement in a striking path to strike the exterior of said bell.

13. The improvement of claim 12 including a bendable finger on said armature and stop on said housing bridge adjacent the end of said armature and remote from the armature pivot for adjusting the travel of said striker.

14. The improvement of claim 12 in combination with a microwave oven transformer having a primary circuit including a surge resistance element, said element comprising a fusible wire wrapped around and supported on said coil and electrically connected in series with line current and said primary in which said electromagnetic device has a contact structure electrically connected in said circuit between said primary and line current to shunt said surge resistance element after a delay as said coil is energized.

* * * * *